US007316130B2

(12) United States Patent
Mørkenborg

(10) Patent No.: US 7,316,130 B2
(45) Date of Patent: Jan. 8, 2008

(54) ORNAMENTAL ELEMENT FOR A JEWELRY SYSTEM AND A JEWELRY SYSTEM COMPRISING SUCH ORNAMENTAL ELEMENT

(75) Inventor: Kirsten Elisabeth Mørkenborg, Bredsten (DK)

(73) Assignee: Interlego AG, Baar (CH)

( * ) Notice: Subject to any disclaimer, the term of this patent is extended or adjusted under 35 U.S.C. 154(b) by 47 days.

(21) Appl. No.: 10/332,865

(22) PCT Filed: Jul. 12, 2001

(86) PCT No.: PCT/DK01/00486

§ 371 (c)(1),
(2), (4) Date: Aug. 7, 2003

(87) PCT Pub. No.: WO02/05677

PCT Pub. Date: Jan. 24, 2002

(65) Prior Publication Data

US 2004/0035151 A1 Feb. 26, 2004

(30) Foreign Application Priority Data

Jul. 13, 2000 (DK) ..... 2000 01085

(51) Int. Cl.
*A44C 15/00* (2006.01)
*A44C 1/00* (2006.01)
*A44C 19/00* (2006.01)

(52) U.S. Cl. ..... 63/29.1; 63/20; 63/15.7; 63/40; 63/15.4; 63/18

(58) Field of Classification Search ..... 63/18, 63/20, 15.7, 40, 15.4
See application file for complete search history.

(56) References Cited

U.S. PATENT DOCUMENTS

| | | | | |
|---|---|---|---|---|
| 996,678 | A * | 7/1911 | Reynolds | 63/29.1 |
| 2,716,794 | A * | 9/1955 | Zelenay | 24/113 R |
| 4,309,879 | A * | 1/1982 | Gretz et al. | 63/29.1 |
| 4,611,368 | A * | 9/1986 | Battersby | 24/116 R |
| 4,793,155 | A * | 12/1988 | Law | 63/40 |
| 5,214,940 | A * | 6/1993 | Capifali | 63/21 |
| 5,440,900 | A * | 8/1995 | White | 63/38 |
| 5,606,874 | A | 3/1997 | Archetti et al. | 63/21 |

(Continued)

FOREIGN PATENT DOCUMENTS

| | | |
|---|---|---|
| DE | 1087388 | 8/1960 |

(Continued)

*Primary Examiner*—Flemming Saether
*Assistant Examiner*—David C Reese
(74) *Attorney, Agent, or Firm*—Day Pitney LLP

(57) ABSTRACT

An ornament (1; 11; 21) for a jewellery system, which ornament (1; 11; 21) comprises a base portion (2; 22) that is provided with at least one notch (3; 23*a*, 23) for receiving an elongate element, and ornamental element (4; 14; 24*a*, 24*b*) that can be mounted on the base portion in such a manner that it extends across the notch and thus encloses the elongate element. The base portion (2; 22) and the ornamental element (4; 14; 24*a*, 24*b*) are configured such that the ornamental element (4; 14; 24*a*, 24*b*) can, in a releasable manner, be mounted on the base portion (2; 22) with any randomly selected orientation relative to the notch (3; 23*a*, 23*b*). Additionally, a jewellery system that comprises an elongate element and at least one ornament (1; 11; 21) as described above.

10 Claims, 1 Drawing Sheet

U.S. PATENT DOCUMENTS

| | | | | |
|---|---|---|---|---|
| 5,687,585 | A * | 11/1997 | Ferrell | 63/21 |
| 6,094,939 | A * | 8/2000 | Gavello | 63/3 |
| 6,209,351 | B1 * | 4/2001 | Zeleny | 63/1.16 |
| D473,160 | S * | 4/2003 | Weissman | D11/220 |

FOREIGN PATENT DOCUMENTS

| | | |
|---|---|---|
| FR | 2747277 | 10/1997 |
| GB | A 377621 | 3/1932 |
| GB | A 630364 | 5/1939 |
| GB | 2069817 | 9/1981 |

* cited by examiner

ORNAMENTAL ELEMENT FOR A JEWELRY SYSTEM AND A JEWELRY SYSTEM COMPRISING SUCH ORNAMENTAL ELEMENT

The invention relates to an ornament for a jewellery system, in which the ornament comprises a base portion provided with at least one notch for receiving an elongate element and an ornamental element that can be mounted on the base portion in such a manner that it extends across the notch and thereby encloses the elongate element. Besides the invention relates to a jewellery system comprising an elongate element and further comprising at least one ornament as described above.

Such ornament and such jewellery system are known from German patent publication No. 1,087,388 that shows a jewellery bead that is provided with at least one through-going bore and a notch that extends from the outside of the bead into the through-going bore. The through-going bore thus constitutes the bottom of the notch and the bead can be mounted on a string by the string being conveyed down into the bottom of the notch until arranged in the through-going bore. The notch is wedge-shaped and a wedge element is provided that can be pressed down into the notch and by means of barbs being secured therein. The wedge element can be mounted in one manner only that makes the bead spherical.

Besides, U.S. Pat. No. 5,440,900 also teaches ornaments for mounting on a jewellery chain, which the ornaments are configured for being tightly squeezed around the chain. Each of these ornaments consist of a dish-shaped portion with an open back and a closed front, wherein a jewellery element can be mounted, e.g. in the shape of a gem. Upon mounting on a jewellery chain, the chain is conveyed through notches or openings in the lateral walls of the ornament and is clasped in place by means of a clasping element. Thus, the ornaments are secured in a releasable manner and their positioning relative to each other on the chain can be varied. However, there is no possibility of varying the ornamental elements of the individual ornament.

Finally, FR-A1-2,747,277 discloses a jewellery system, wherein the ornaments comprise a base portion that is, by means of gluing or mechanical deformation, attached on several chains. By using magnets in the base portions and magnetic materials in the associated ornamental elements, it is possible to secure the ornamental elements in a releasable manner on the base portions. Thus, this jewellery system enables exchange of the individual ornamental elements, but it does not provide the option of changing the locations of the base portions on the chains.

In order to be able to further vary jewellery of these types, there is a need for ornaments for mounting on a string, a chain or any other elongate element, said ornaments providing a higher degree of flexibility with regard to the options of variations compared to the prior art mountable beads or ornaments.

It is thus an object of the invention to provide an ornament and a jewellery system that provide these further options for variations.

This is obtained by configuring the ornament described above such that the base portion and the ornament is configured such that the ornament can, in a releasable manner, be mounted on the base portion with a randomly selected orientation relative to the notch.

Hereby it is obtained that, in addition to being mountable on an elongate element, such as a string, a chain, a bar or the like, the ornament also comprises an ornamental element that can be configured to be irregular and that can be oriented as desired in the base portion of the ornament.

The interconnection between the base portion and the ornamental element can be configured in various ways, but according to a preferred embodiment the base portion is provided with a simple circular recess, in which the ornamental element can be mounted.

In order to ensure adequate attachment of the ornamental element in the base portion, the circular recess in the base portion can be undercut, while simultaneously the ornamental element is provided with at least one holder flap having an outwardly protruding collar that is able to engage with the undercut recess. By this configuration of the base portion and the ornamental element it is possible to establish a snap-coupling between the two portions. Such coupling means that the ornamental element is readily mounted as well as dismounted.

According to a preferred embodiment the base portion is configured as a circular ring, wherein the at least one notch is located diagonally on the one side of the base portion, and wherein the circular recess constitutes a through going opening through the base portion. By this embodiment the base portion is generally configured as a rotationally symmetrical element, apart from the notch, and the recess being configured as a through-going opening enables mounting of ornamental elements on both sides of the base portion.

Preferably the notch in the base portion extends into a central plane in the circular opening such that a mounted, elongate element extends substantially through this plane whereby a well balanced mounting is obtained.

In order to provide durable, but yet flexible elements the base portion as well as the ornamental element is preferably made of plastics.

The jewellery system according to the invention comprises an elongate element and at least one ornament configured as featured above. By the jewellery system it is thus possible to construct several different pieces of jewellery provided with the ornamental elements that are mounted on the elongate element.

Preferably, at least one groove provided in the base portion has such width that the elongate element can be secured in the notch by squeezing. Hereby simple attachment of the ornament on the elongate element is obtained and a further attachment can be obtained by the mounting of the ornamental element on that side of the base portion that is provided with the notch, the elongate element hereby being confined at the notch bottom by the ornamental element.

The elongate element can be configured as an inflexible rod that is optionally shaped to form a necklace or a bracelet. However, in the preferred embodiment the elongate element is configured to be flexible and is provided with coupling means at its ends. This elongate, flexible element can thus be used for very flexible applications and for the construction of various structures.

According to one embodiment at least the one coupling means at the end of the elongate, flexible element is configured as a base portion that corresponds to the base portion of the ornaments. Hereby further options of variations are obtained, since—on the one hand—it is possible to mount ornamental elements in the base portion, and—on the other hand—it is possible for the base portion via the notch to be caused to engage with another part of the elongate, flexible element.

According to an alternative embodiment at least the one coupling means at the end of the elongate, flexible element is configured as a spherical element having a diameter that exceeds the overall thickness of the elongate, flexible element. Such spherical element at the end of the elongate flexible element serves, on the one hand, as a stop for how far towards the end of the elongate, flexible element an ornament can be mounted and, on the other, as an elegant finishing of the elongate, flexible element if that end remains free after mounting of various ornaments.

Preferably the elongate, flexible element is configured as a metal chain that provides a secure basis for engagement with a notch provided in the base portion of the ornament.

The invention will now be described in further detail with reference to the drawing, wherein FIG. 1 shows an ornament according to a first embodiment;

Figure 1:
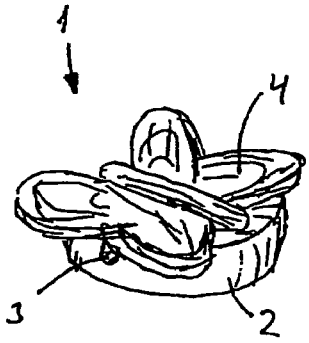

FIG. 1 shows an ornament 1 for a jewellery system, which ornament 1 comprises a base portion 2 that is provided with at least one notch 3 for mounting on an elongate element, such as a chain, a string, a rod, strand of hair or the like. The ornament also comprises an ornamental element 4 that is releasably mounted on the base portion 2. In the embodiment shown the ornamental element 4 is configured as a butterfly, but the ornamental element may have other shapes as will be apparent from the following.

Figure 2:
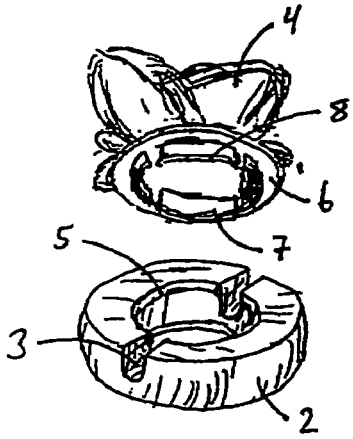
FIG. 2 shows the ornament separated in a base portion and an ornamental element.

In FIG. 2 the ornament 1 is shown separated in its two parts: the base portion 2 and the ornamental element 4 that can be assembled and separated by means of a snap-coupling as will be described below.

In the embodiment shown the base portion 2 is configured as a circular ring with a through-going opening. Its upper and lower sides perpendicular to the through-going opening are plane, whereas its outer surface is configured curved. Diagonally on the upper side a notch 3 is provided that is configured for being able to receive an elongate element, such as a chain, a string, a rod, strands of hair or the like. The bottom of the notch 3 is located to be substantially level with the central plane of the base portion 2, such that an elongate element arranged in the notch is caused to be situated substantially in this central plane of the base portion 2.

The through-going opening is configured with undercut edges, there being provided at the upper and lower sides of the base portion 2 inwardly oriented collars or beads 5 that constitutes a part of the snap coupling between the base portion 2 and the ornamental element 4.

On the bottom face the ornamental element 4 is provided with a disc 6 that in turn is provided with four downwardly oriented holder flaps 7 that each constitutes a circle with a diameter that corresponds to the diameter of the through-going opening in the base portion 2.

Each holding flap 7 is provided with an outwardly oriented collar or bead 8 that is configured for engaging with the collar or bead 5 of the base portion 2 provided in the through-going opening when the ornamental element 4 is mounted in the base portion 2. Owing to the configuration of the connecting means the orientation of the ornamental element relative to the notch 3 in the base portion 2 can be selected freely.

The ornament 1 can be mounted on an elongate element by it being located in the notch 3 on the base portion 2. If the elongate element fits tightly into the notch 3, ie it has a width that slightly exceeds the width of the notch 3, it may be secured exclusively by means of the friction between the sides of the groove 3 and the elongate element. Preferably the notch 3 has such depth that the ornamental element 2 can still be mounted on the base portion 2 when it is mounted on an elongate element. If the elongate element does not fit tightly into the notch 3, however, it may still be used, the ornament 1 thus becoming, in that case, merely loosely mounted on the chain or the string; ie the mounted ornament can be displaced freely on the elongate element As mentioned above, the elongate element may comprise a chain or a string, whereby one or more ornaments 1 may be constituents of a jewellery system with necklaces, bracelets and the like. However, the elongate element may also be shaped as rigid rods or rings on which one or more ornaments 1 can be mounted or it may consist of the user's hair, viz a number of strands of hair being located in the notch 3 of the base portion 2, following which an ornamental element 4 is mounted and squeezes the hair in place within the notch 3.

Figure 3:
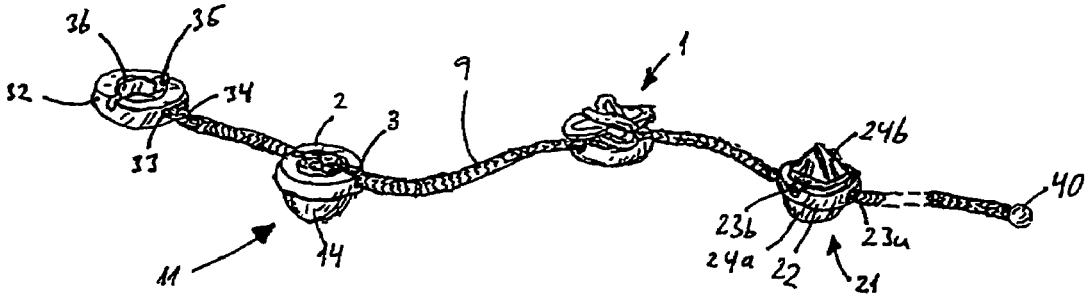
FIG. 3 shows a chain with ornaments mounted thereon.

Now FIG. 3 shows an elongate element in the form of a chain 9 and ornaments 1, 11, 21 that are mounted on the chain 9. The chain 9 is made of metal rings that are connected axially to each other with only a small axial clearance between each metal ring. Such chain 9 appears like a compact, elongate, flexible element that is extremely suitable for use in combination with the ornament shown in FIGS. 1 and 2, since it is very stable dimensionally in the transversal direction and therefore it may in a suitable manner be pressed down into the notch 3 of a base portion 2 and be secured therein by a clasping effect.

At the one end the chain 9 is provided with a coupling means that is configured as a base portion 32 that is configured essentially like the base portion 2 shown in FIGS. 1 and 2. On the side, the base portion 32 is provided with an eye 33 in which the chain 9 is secured via a second eye 34. The base portion 32 is provided with a notch 35 as well as an inwardly extending collar or bead 36 in the through-going opening. Thus the base portion 32 can receive both a second elongate element in the notch 35 and be fitted with an ornamental element 4 in the same manner as the base portion 2 shown in FIGS. 1 and 2. Of course, the chain 9 can also be closed to form a closed ring if the opposite end of the chain 9 is mounted in the notch 35.

At the second end the chain 9 is provided with a spherical element 40, whose diameter slightly exceeds the diameter of the chain 9. Thus, this spherical element can act both as an end stop for an ornament 1 and as an elegant finishing of the chain 9, if it is used with a loosely suspended end.

The ornament 1 that is shown in details in FIGS. 1 and 2 are mounted and secured on the chain 9 by the chain 9 being pressed into the notch 3, following which the ornamental element 4 is mounted by means of the holder flaps 7, whose outwardly extending collar 8 cooperates with the inwardly oriented beads 5 in the through-going opening of the base portion 2. Owing to the configuration of the through-going opening of the base portion 2 and the holder flaps 7 of the ornamental element 4, it is possible—as mentioned above—to orient the ornamental element 4 in any randomly selected manner relative to the chain 9.

In principle the ornamental element 11 corresponds to the ornament 1, as it comprises a base portion 2 and an ornament 14. The base portion 2 is mounted on the chain 9 by the chain 9 being pressed down into the notch 3 and secured therein by clasping effect. In this case the ornamental element 14 is dome-shaped and mounted on that side of the base portion 2 that is opposite the notch 3.

In principle the ornament 21 also corresponds to the ornament 1 shown in FIGS. 1 and 2, it comprising, however, a base portion 22 that is provided with two notches 23*a* and 23*b* provided on each of their side of the base portion 22. The two notches 23*a*, 23*b* extend diagonally across the base portion 22 and are located perpendicular to each other. Thus, the base portion 22 can, according to choice, be mounted on an elongate element from the one side or the other side, or optionally from both sides at the same time to form a cross between the two elongate elements.

In the mounting shown of the ornament 21, the chain 9 is mounted in the notch 23*a*, and to each side of the base portion 22 a dome-shaped ornamental element 24*a* and a pyramidal ornamental element 24*a*, respectively, are mounted. The dome-shaped ornamental element 24*a* as well as the pyramidal ornamental element 24*b* are preferably made of transparent, stained glass or plastics.

Figure 4:
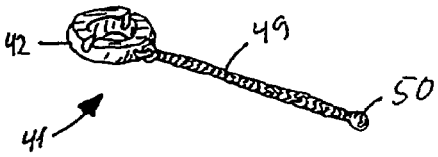
FIG. 4 shows a chain extension.
Figure 5:
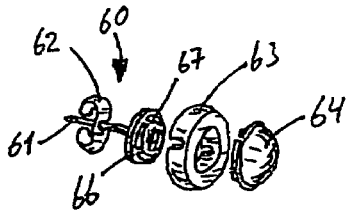
FIG. 5 shows an alternative use of an ornament according to the invention as a part of an earring.

FIGS. 4 and 5 show other elements that may be constituents of the jewellery system according to the invention.

FIG. 4 shows a chain extension 41 that is, in principle, constructed in the same manner as the chain 9 shown in FIG. 3, viz comprising a base portion 42, a chain 49 and a spherical element 50. The chain extension 41 can be used to extend the chain 9 shown in FIG. 3 or more chain extensions 41 can be mounted in succession to form a longer chain. The chain extension 41 can also be used as a pendant or charm for a necklace or a bracelet, the base portion 42 being mounted on a chain like the chain 9 shown in FIG. 3, whereas the chain 49 and the spherical element 50 are merely loosely suspended. Other applications for the chain extension 41 are also possible.

FIG. 5 shows how an ornament 1 can be used in connection with an earring 60. The earring 60 comprises a pin 61 for mounting through a piercing in an ear and a lock 62 that can be clasped on the pin 61. The foremost end of the pin 61 is provided with a circular disc 66 that is provided with forwardly oriented holder flaps 67 that correspond to the holder flaps 7 on the ornamental element 4 shown in FIG. 2. A base portion 63 that corresponds to the base portion 2 shown in FIGS. 1 and 2 can thus be mounted on the earring and an ornamental element 64 can be mounted on the opposite side of the base portion 63.

The invention has been described with reference to preferred embodiments of ornaments and of the jewellery system. All constituent parts, however, can be configured in other ways without thereby departing from the inventive idea.

For instance, the base parts need not be configured as rings; they may have any other configuration as long as the coupling means between the base portions and the ornamental elements ensure that the ornamental elements can be mounted releasably with any randomly selected orientation relative to the notch with which the base portion is mounted on the elongate element, such as a chain, a string, a rod, strands of hair or the like.

The length of a chain or string that is a constituent of the jewellery system can also be varied depending on the field of application for the individual chain or string. Finally it is of course possible to configure the ornamental elements in a wide variety of ways other than those shown in FIGS. 1-5.

The invention claimed is:

1. An ornament (1;11;21) for a jewellery system, in which the ornament (1;11;21) comprises a base portion (2;22;63) that is provided with at least one notch (3;23*a*, 23*b*) for receiving an elongate element, and an ornamental element (4;14;24*a*, 24*b*;64) that is completely detached from the base portion and can be mounted on the base portion in such a manner that it extends across the at least one notch and thus encloses and attaches the elongate element; wherein the base portion (2; 22; 63) is provided with a circular recess completely about its inner periphery in which the ornamental element (4; 14; 24*a*, 24*b*; 64) can be releasably mounted, there being provided an inwardly extending bead (5), at an edge of the recess and the ornamental element (4; 14; 24*a*, 24*b*; 64) is provided with at least one holder flap (7) with an outwardly extending collar (8) that is able to engage the inwardly extending bead (5) in a snap coupling, whereby the ornamental element (4; 14; 24*a*, 24*b*; 64) can, in a releasable manner, be mounted on the base portion (2; 22; 63) in any randomly selected orientation relative to the at least one notch (3; 23*a*, 23*b*).

2. An ornament according to claim 1, characterized in that the base portion (2; 22; 63) is configures as a circular ring, the at least one notch (3; 23*a*, 23*b*) being located diagonally on one side of the base portion (2; 22; 63) and the circular recess forming a through-going opening through the base portion (2; 22; 63).

3. An ornament according to claim 2, characterized in that the at least one notch (3; 23*a*, 23*b*) in the base portion (2; 22; 63) extends down to a central plane in the circular ring.

4. An ornament according to claim 1, characterized in that the base portion (2; 22; 63) as well as ornamental element (4; 14; 24*a*; 24*b*; 64) is made of plastics.

5. A jewellery system to claim 1, characterized in that at least one notch (3; 23*a*, 23*b*) provided in the base portion (2; 22; 63) has such width that the elongate element can be secured in the at least one notch (3; 23*a*, 23*b*) by a clasping effect.

6. A jewellery system according to claim 1, characterized in that the elongate element is flexible and is provided with coupling means at its ends.

7. A jewellery system according to claim 6, characterized in that the coupling means at an end of the elongate, flexible element is configured as a base portion (32; 42) that corresponds to the base portion (2; 22; 63) in the ornament.

8. A jewellery system according to claim 6, characterized in that the coupling means at an end of the elongate, flexible element has the shape of a spherical element (40, 50) with a diameter that exceeds the overall thickness of the elongate, flexible element.

9. A jewellery system according to any one of claims 6-8, characterized in that the elongate, flexible element is configured as a chain (9; 49).

10. A jewellery system according to claim 9, characterized in that the chain (9; 49) is made of metal.

* * * * *